United States Patent [19]

Gross

[11] Patent Number: 4,724,902

[45] Date of Patent: Feb. 16, 1988

[54] PLATE HEAT EXCHANGER

[75] Inventor: Heinz Gross, Mühltal, Fed. Rep. of Germany

[73] Assignee: Röhm GmbH Chemische Fabrik, Darmstadt, Fed. Rep. of Germany

[21] Appl. No.: 890,642

[22] Filed: Jul. 30, 1986

[30] Foreign Application Priority Data

Aug. 6, 1985 [DE] Fed. Rep. of Germany ..... 8522627

[51] Int. Cl.[4] ..... F28F 3/04

[52] U.S. Cl. ..... 165/166; 165/167

[58] Field of Search ..... 165/166, 167

[56] References Cited

U.S. PATENT DOCUMENTS

| | | | |
|---|---|---|---|
| 1,328,323 | 1/1920 | Fedders . | |
| 2,288,061 | 6/1942 | Arnold . | |
| 2,550,339 | 4/1951 | Ehrman . | |
| 3,119,446 | 1/1964 | Weiss . | |
| 3,291,206 | 12/1966 | Nicholson . | |
| 4,460,388 | 7/1974 | Fukami et al. . | |
| 4,470,453 | 9/1984 | Laughlin et al. . | |
| 4,544,513 | 10/1985 | Otterbein | 165/166 X |

FOREIGN PATENT DOCUMENTS

| | | | |
|---|---|---|---|
| 2910005 | 9/1980 | Fed. Rep. of Germany . | |
| 3008717 | 9/1981 | Fed. Rep. of Germany | 165/166 |
| 8504949 | 11/1985 | PCT Intl Appl. | 165/166 |
| 253573 | 11/1948 | Switzerland . | |
| 821430 | 10/1959 | United Kingdom . | |
| 954066 | 4/1964 | United Kingdom . | |
| 1223752 | 3/1971 | United Kingdom . | |
| 800569 | 2/1981 | U.S.S.R. | 165/166 |

*Primary Examiner*—Albert W. Davis, Jr.
*Assistant Examiner*—Richard R. Cole
*Attorney, Agent, or Firm*—Oblon, Fisher, Spivak, McClelland & Maier

[57] ABSTRACT

A plate heat exchanger, in particular of synthetic material is disclosed consisting of a stack of plates which are corrugated in two directions transverse to each other. The plates are so arranged in the stack that the corrugations of consecutive plates run in equiphase in one direction and in antiphase in the other direction. In the direction of the corrugation in equiphase, perfusable channels pass.

11 Claims, 10 Drawing Figures

Fig.6
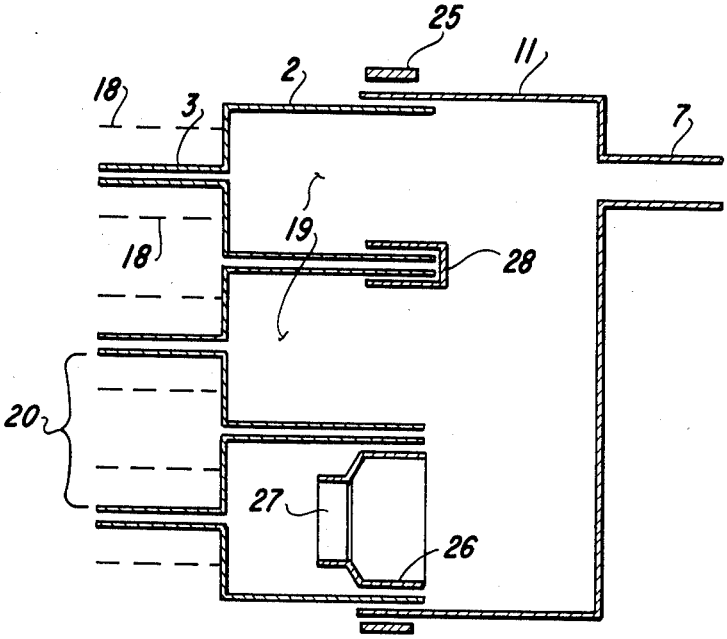
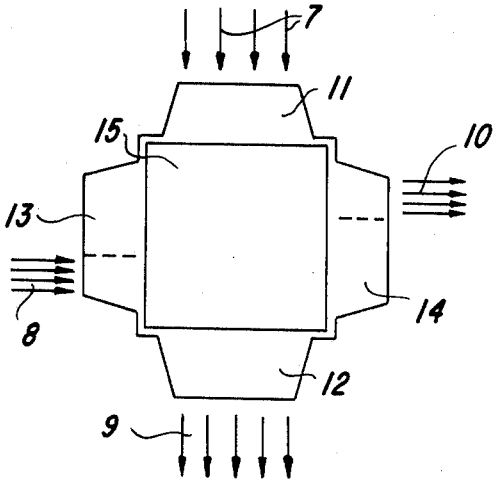
Fig. 5

PLATE HEAT EXCHANGER

BACKGROUND OF THE INVENTION

1. Field of the Invention

The invention generally concerns a plate heat exchanger. More specifically, the invention concerns a plate heat exchanger body. The plate heat exchanger consists of a stack of corrugated plates between which perfusion channels pass. The region in which heat is exchanged between these channels is the actual heat exchange body. The complete heat exchanger also includes a system for admitting and discharge conduits to the individual channels for the flowing mediums. The invention concerns first and foremost a new design for a plate heat exchanger body, which in the traditional manner can be equipped with admitting and discharge conduits for the flowing mediums.

2. Discussion of the Background

The known plate heat exchanger (See Ullmann, *Enzyklopädie der technischen Chemie,* 4th edition, volume 2, page 440) consists of a stack of a number of corrugated or otherwise contoured plates which, divided from each other by seals, can be held together in a press. After opening of the press, the plates separate easily from each other and can be cleaned.

So-called lamellar or stack heat exchangers are constructed from a stack of alternately flat and corrugated metal sheets, whereby the direction of the corrugation of the corrugated sheet metal alternates. At the four lateral faces of the stack, a receptable and an admitting, or respectively, a discharge conduit for the flowing mediums are installed. The mediums, between which heat is exchanged, can only be conducted transversely to each other and the heat transfer takes place only at the flat metal sheets.

Plate or lamellar heat exchangers are inexpensive due to their simple construction and easy to maintain and clean through easy disassembling and reconstructing.

SUMMARY OF THE INVENTION

The object of the invention is to improve the effectiveness of plate heat exchanger bodies, consisting of a stack of corrugated plates, between which perfusion channels pass and maintain a simple construction.

This object and other objects which will become apparent from the following specification have been achieved by the heat exchanger body of the present invention which is constructed from plates which are corrugated in sections in two directions lying transverse to each other. In the stack, consecutive plates are so arranged that the corrugations run in transversely corrugated regions or sections in equiphase in one direction and in antiphase in the other direction.

The plates used in the construction of the heat exchange body are easily manufactured because they are treated as a unifacial body without ribs protruding from the surface or projectures. These plates are easily manufactured according to known processes through a forming operation of a level surface material. In the case of stacking plates in the manner of the invention, a number of parallel channels result between every two plates which are perfusable by a liquid or gaseous medium. These channels have a corrugated course through which the flowing medium is strongly swirled. A turbulent boundary film is already formed thereby in the case of negligible flow rates which leads to an increase in the heat transfer coefficient. Furthermore, through the transverse corrugation of the plate segments, a considerable expansion of the surface area available for heat exchange results. The heat exchange is thereby further expedited. All channel walls are touched by both media so that practically no walls are ineffective for the heat exchange between the channels flooded by the same medium.

Through the biaxial corrugation, each individual plate has a high rigidity. The rigidity is further considerably strengthened by joining the plates to a stack, since all individual plates support each other by staying mutually at narrow distances on each other. Accordingly, even if thin-walled material is used for the individual plates, one obtains a mechanically extraordinarily stiff and stabile heat exchange body of negligible weight and high exchange capacity.

The heat exchanger of the present invention is suitable for heat exchange between liquid or gaseous mediums or between a liquid and a gaseous medium. It is particularly suitable for preparation of large heat exchange arrangements, in particular in cooling towers, where a number of heat exchange bodies are placed together for one large cooling system.

The heat exchange body can also serve simultaneously as a chemical reactor if the channels are filled in one direction with a perfusable catalyst mass, or its walls are coated with a catalyst material. The channels can also be filled with perfusable absorption materials so that the heat exchange body works simultaneously as a filter.

The simple manner of manufacture of the heat exchanger body allows for the construction of heat exchange bodies of any dimension and may be adopted to most any medium whatever its chemical composition.

BRIEF DESCRIPTION OF THE DRAWINGS

A more complete appreciation of the invention in many of the attendant advantages thereof will be readily obtained as the same becomes better understood by reference to the following detailed description when considered in connection with the accompanying drawings, wherein:

FIG. 3 represents the manner of arrangement of the individual plates of a cross-current heat exchanger in a schematic way, whereby the dot-dash line represents a corner of the heat exchange body. Right and left from it, the wave progression of the individual plates in the lateral faces adjacent to the corner is represented in unbroken lines. The thin lines show the projection of the individual biaxial corrugated plates onto the lateral face of the heat exchanger body;

FIG. 4 shows a functional embodiment of the non-corrugated edge of a plate as well as an embodiment for preparation of direct-current or counter-current heat exchangers. In addition.

FIG. 5 shows in survey a heat exchange body with affixed receptacles and connection conduits; and FIG. 6 shows a cross-section through the edge of a heat exchanger body along the line AB in FIG. 4*a* with connected receptacle and connection conduit.

DETAILED DESCRIPTION OF THE PREFERRED EMBODIMENTS

Figure 1:
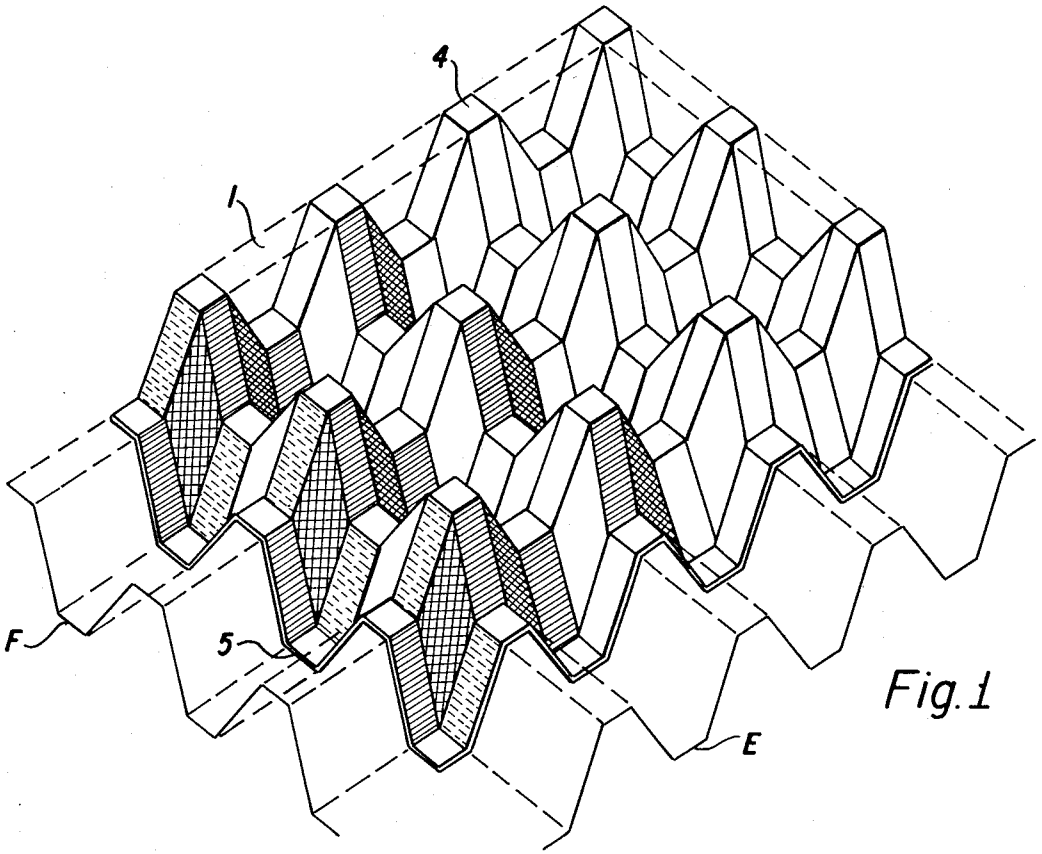
FIG. 1 shows in perspective view a biaxial corrugated plate suitable for the construction of a recuperator body, or respectively, a sectional detail for such a plate.
Figure 2:
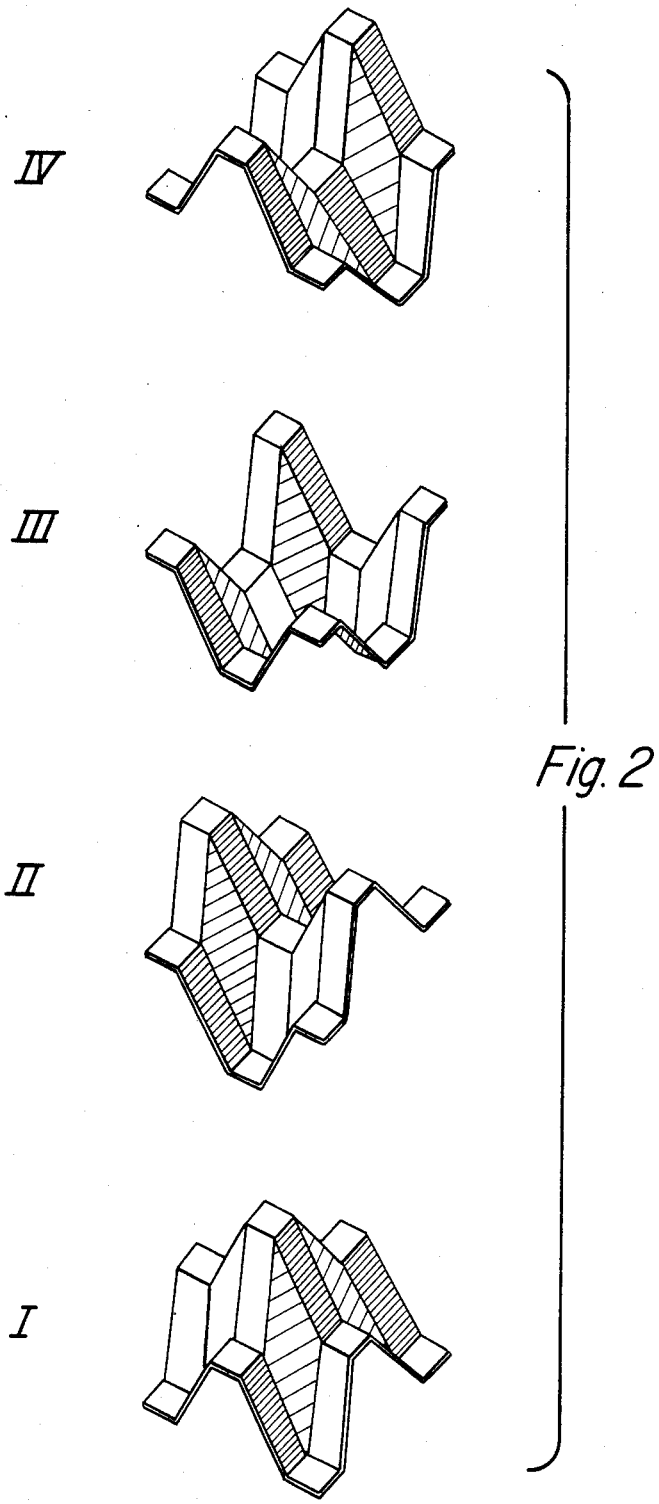
FIG. 2 shows sectional details from four plates superimposed on each other of an embodiment of the present cross-current heat exchange body in perspective explosion representation.

Referring now to the drawings, wherein like reference numerals and letters designate identical or corresponding parts throughout several views, and particularly to FIG. 1 thereof, wherein the surface form of a biaxial corrugated plate is formed geometrically so that a wave curve E as a generatrix is displaceable parallel to a wave-shaped guide curve F. The role of the guide curve and the generatrix are interchangeable. Each section plate which is placed parallel to the generatrix E through the biaxial corrugated surface has the profile of the generatrix E. Likewise, each section plate which is placed parallel to the guide curve F through the biaxial corrugated surface has the profile of the guide curve F. A layering which generates channels allowing for perfusion suffices in practice when the ideal geometric form is approximated in this way.

At the crossing points of the wave maxima and wave minima, through superposition of both wave trains, there result roofs 4 and valleys 5, between which saddle regions lie whose highest, or respectively, lowest points lie on an elevation level that forms the middle between the level of the roofs 4 and the level of the valleys 5.

Both the corrugation axes E and F as a rule stand at a right angle to each other. Nevertheless, this is not a prerequisite for the construction of the heat exchange body. Likewise, it is desirable, but not mandatory, that the wave trains E and F correspond to wavelength and wave amplitude.

The wave form is so selected that two waves of adjacent plates in equiphase may accommodate each other as closely as possible. Sine waves, trapezoidal waves and types of waves lying in between are suitable, where individual waves can be constructed from arced and bent linear sections. In FIGS. 1 to 6, a trapezoidal curve was used as the basis for the wave curves E and F.

The channels form themselves when the biaxial corrugated plates are layered upon each other in the manner according to the present invention. For that reason, the configuration of the outer edges of the individual plates is basically optional. In order to be able to easily install the admitting and discharge conduit, however, it is desirable for all plates to have an equivalent area, so that they form a common lateral face in the stack. A rectangular area is preferred.

The wavelength and the wave amplitude are selected in accordance with the intended use of the heat exchanger body as well as according to the manner of manufacture of the plates. The ratio of wave amplitude to wavelength lies mainly between 1:10 to 1:1. A high ratio within this range promotes strong swirling of the flowing medium and thereby good heat transfer, but leads to high flow resistance. In the case of a decreasing ratio between amplitude and wavelength, the flow resistance first decreases but then again increases due to increased narrowing of the channel cross-section. The wavelength lies preferably in the range of 10 to 500 mm, the wave amplitude correspondingly in the range of 1 to 150 mm. The number of waves in longitudinal and transverse direction can be freely selected according to the technical requirements. The lengths of the lateral edges of a rectangular area are preferably from 0.1 to 3 m and the number of waves per side are generally 10 to 400.

Many materials are suitable for the manufacture of the biaxial corrugated plates. For example, metals; ceramic materials, such as clay, porcelain or glass; synthetic material, such as thermoplastic, duroplastic, or fiber-reinforced plastics or plastic-filled contexture or fibrous webs are applicable. Particularly advantageous are smooth, flat materials, which allow reshaping to a biaxial corrugated shape. Examples include sheet metals from steel, aluminum, copper and other metals or alloys, as well as thermoplastic, or thermoelastic moldable synthetic-material sheets. Appropriate synthetic-material sheets of this type consist of, for example, acrylic glass (polymethylmethacrylate and methylmethacrylate-copolymers); polyvinyl chloride; polyolefins, such as polyethylene or polypropylenes; polycarbonates, such as bisphenol-A-polycarbonate; polysulfones; polyimides; and polyesters. Suitable as well are fiber-filled synthetic materials, such as the so-called prepregs, which generally consist of a glass fibrous web and a heat-curing epoxy resin.

The original sheet materials are brought into the desired biaxial corrugated shape in the manufacture of biaxial corrugated plates by thermoforming between two suitable corresponding tools. In the case of the thermoforming of synthetic materials in the thermoelastic condition, it is not necessary to use fully elaborated form tools. It suffices when the farthest maxima 4 and minima 5 are produced through suitable plugs. The intermediate wave forms are produced by themselves under the effect of elastic counterforces arising in the thermoforming in the required manner. For this thermoforming, synthetic-material sheets of a thickness of 0.01 to 3 mm can be utilized. In a corresponding manner, metallic sheet metal can be reshaped.

Figure 3A:
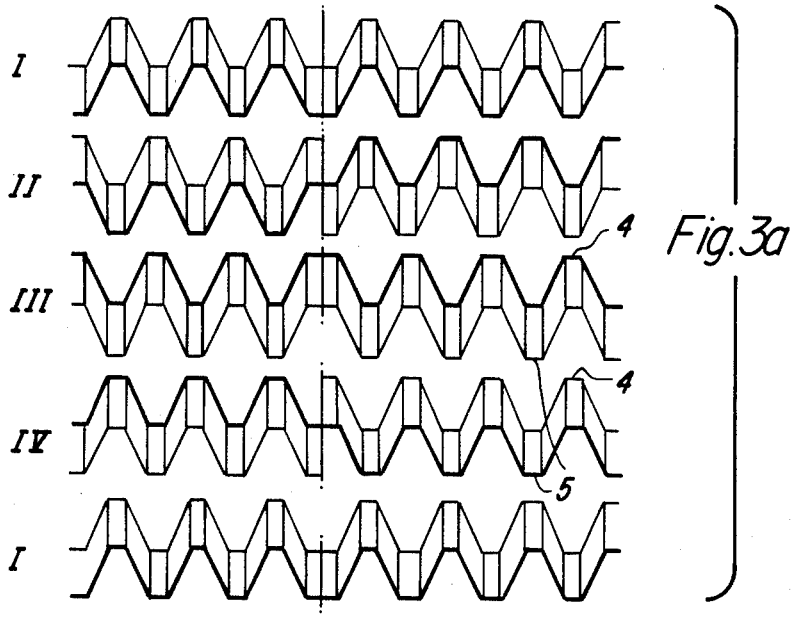
FIG. 3*a* shows the arrangement in explosion representation.
Figure 3B:
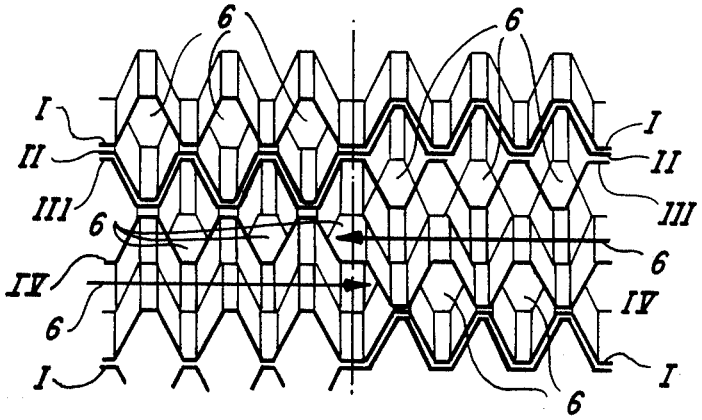
FIG. 3*b* in operational arrangement.

The heat exchanger body with alternate sections of parallel channels for each of both mediums is formed from three or more biaxial corrugated plates layered upon each other. Every other plate adds a further layer of parallel flow channels. The plates are stacked in such a manner that the corrugations of two consecutive plates at any given time run in equiphase in the direction of one wave axis and in antiphase in the direction of the other wave axis. Plates which display a continuous uniform transverse corrugation may be constructed for a cross-current recuperator, whereby the directions of the equiphase and antiphase course change with each plate. As FIG. 3 shows, four different settings of the individual plates result, which in FIG. 3 are designated by I to IV. The position of the fifth plate is again in accordance with the position of the first.

When the plates have a lateral-edge length (determined from their projection on the base plane) of uneven multiples of half wave lengths, a cross-current recuperator can be constructed from the desired number of perfectly identical stacked individual plates with their respective lateral edges lying in a plane. At any given point, these plates are arranged in a staggered configuration around a quarter turn. This manner of construction is particularly advantageous because one can manufacture biaxial corrugated plates without waste, with a single pair of form tools which respectively can be brought into each of the four settings I to IV (FIG. 2) through quarter turns.

The cross-current recuperator has the advantage that the admitting conduits 7 and 8 and the discharge conduits 9 and 10 for two perfusion mediums can be particularly easily connected to the heat exchange body 15 in which onto each of its four lateral faces one receptable (11, 12, 13, 14) is connected, respectively, from which two facing receptables each (11 and 12 or respectively 13, 14) conduct one of two mediums.

A higher heat exchange conduction is possessed by counter-current heat exchangers in which all channels run parallel in all levels. This construction permits putting the invention into practice in a simple way, whereby one stacks the planar elements always in the same direction in phase. In this case however the ends of the channels for both mediums alternate layer by layer at two facing sides of the plate stack and have to be connected alternately layer by layer to the respective supply conduits. This disadvantage can be avoided if the plates display a transverse corrugation only in a middle region 16, e.g., three-quarters of the total surface. The external region 17 adjacent on both sides can be non-corrugated. The plates are so stacked that the channels lie parallel to one another in all layers and lead from the one external region 17 into the facing external region.

Preferably, the edges of the plates with respect to the middle plane 18 form a step 2 upward in the direction of the edge opposite middle and in the other direction a step 3 downward. Consecutive plates in the stack are packed opposing each other whereby in each layer an approach funnel 19 or 20 is formed respectively. The funnel 19, extending to the corners, is closed at each corner of the plate stack with an elastic sealing block 21 at the side. If receptacles 11, 12, 13 and 14 according to FIG. 5 are adjoined to the sides of the heat exchanger body 15, and the conduits 7 and 9 are used as admission or respectively, discharge for the other medium, and the conduits 8 and 10 are used likewise for the other medium, then one obtains a counter-current heat exchanger. In this case, the approach funnel 20 must be closed by a profile joint 22, so that there is only access from the adjoining receptacle 13 to the one external region 17, while access from the other receptacle 14, there is only access to the other external region.

Figure 4A:
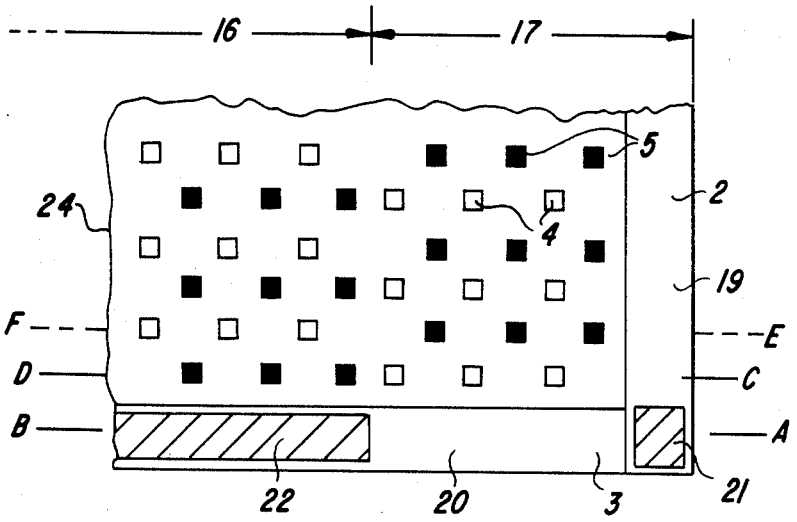
FIG. 4*a* shows a plate in survey, wherein the filled-in squares represent the minimum points and the empty squares the maximum points.
Figure 4B:
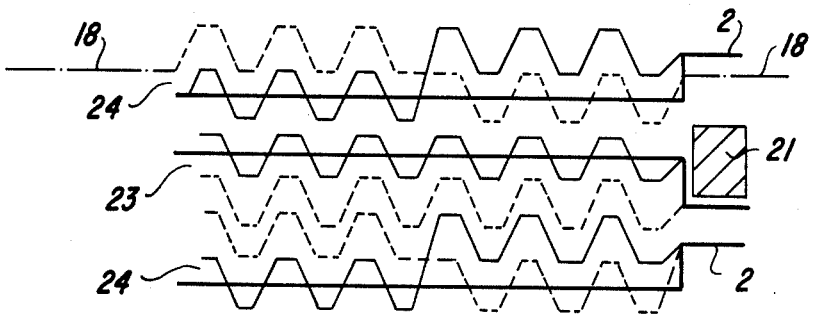
FIG. 4*b* shows intersecting lines through plates arranged stackably over each other, whereby the heavy unbroken lines correspond to the sectional view CD and the dotted lines to the sectional view EF in FIG. 4*a;*

FIG. 4 shows an embodiment in which the plates 24 are also corrugated in the external regions 17, whereby in this region, as well as a larger surface, a higher turbulence and a better heat transfer are attained. Every second plate 23 in the stack is corrugated uniformly biaxial except for the border regions 2 and 3. Between two plates 23 lie at any given time a plate 24, in which the corrugation is displaced in the external regions 17 by a half wavelength. The corrugation runs in equiphase in both directions in the superimposed plates, so that channels are not formed but rather the entire external region is freely perfusable at the same distance at each point.

The number of biaxial corrugated plates which are consolidated into a heat exchanger body is basically optional. It is dependent in each case on the required heat exchange performance and the respective most adequate functional design. Typical heat exchanger bodies have 3 to 100 single planes.

In the case of mere stackings of individual plates into one heat exchanger body, the channels at the lateral edges are not completely sealed. In spite of this, such a stack can be used in many cases as a heat exchange body if slight mixing of both mediums through the leaking flow at the lateral edges can be tolerated This can be the case, for example, for the heat exchange between cool-water flows or between the admission and discharge of air in structures. In these cases, it suffices that the heat exchanger body is held together mechanically by suitable elastic fixtures.

If on the other hand mixing of flowing mediums must be avoided, the individual plates are connected tightly with each other in the border regions 2 and 3. This can be effected for example through an attached U-beam 28, which is laid over two outer edges.

Onto the lateral faces of a heat exchanger body 15 one can fix by pressure receptacles 11, 12, 13 and 14 with a soft flexible sealing coating. It is advantageous to crimp over the edges of the neighboring plates running in equiphase, to glue them or weld them together. Suitable adhesive masses can be added on stacking whenever the plates consist of thermoplastic synthetic material for the simultaneous welding of all tangent lines lying in equiphase at a given lateral fase. exchanger body, a heatable implement can be utilized, into which grooves are notched corresponding to the outer edges of individual plates at the sides of the heat exchanger body. In the case of die-sinking of the lateral face into these grooves, the material is melted up and bonded.

A further possibility for the connection of a receptacle 11 is represented in FIG. 6. It can be drawn back over the lateral faces of the plate stack and be tightly fastened in suitable ways, e.g., through gluing. In order to be able to regularly maintain and clean the heat exchanger, the receptacle is preferably detachably fastened and the connection of the plates is also designed to be detachable. The receptacle can in this case consist of elastic material and be fastened with a tie-rod 25 at least where it lies contiguous to the plate stack. The approach funnels 19 can be reinforced by an inserted U-beam 26 with passage opening 27, in order that the edges 2 are able to press against each other to form a tight seal. A tight seal of the two superimposed edges 2 can also be attained by means of an affixed U-beam 28.

Obviously, numerous modifications and variations of the present invention are possible in light of the above teachings. It is therefore to be understood that within the scope of the appended claims, the invention may be practiced otherwise and that specifically described herein.

What is claimed as new and desired to be secured by Letters Patent of the United States is:

1. A plate heat exchanger body having a plurality of faces, comprising:

a plurality of corrugated plates, stacked to form perfusion channels therebetween, wherein said plates are each at least in part corrugated in two transverse directions, wherein said corrugations are wave-shaped in each direction, and wherein any two adjacent plates of said stack are arranged such that said corrugations run in equiphase in one said transverse direction and in antiphase in the other said transverse direction.

2. The plate heat exchanger body of claim 1, wherein said plates have equal rectangular area and wherein outer edges of all of said plates are coplanar.

3. The plate heat exchanger body of claim 1 or 2, for use as a cross-current recuperator wherein said corrugations are regular for all of said plates and wherein the corrugations of any two adjacent plates alternate between antiphase and equiphase in the direction of stacking.

4. The plate heat exchanger body of claim 1 or 2, for use as a direct-current or counter-current recuperator wherein the corrugations of all adjacent plates are in antiphase in one face and in equiphase in an adjacent face.

5. The plate heat exchanger body of claim 4, including two facing external regions in which a peripheral edge of one said plate does not contact a peripheral edge of an adjacent said plate.

6. The plate heat exchanger body of claim 5, wherein peripheral edges of said plates are not corrugated in said external regions.

7. The plate heat exchanger body of claim 5, wherein said plates are transversely corrugated in said external regions and said corrugations run in equiphase in both said directions.

8. The plate heat exchanger body of claim 2, wherein all edges of each of plates of said stack are non-corrugated running parallel to the center plane of each said plate.

9. The plate heat exchanger body of claim 8, wherein the distance between two adjacent edges varies from the center plane of said plate to the amplitude height of said corrugation and wherein the direction of said variation is inverted at each corner of said stack and two of said adjacent non-corrugated edges are closely superimposed on each other.

10. The plate heat exchanger body of claim 9, wherein said superimposed edges are tightly connected by welding or by an adhesive means.

11. The plate heat exchanger body of claim 1, further comprising a detachable mechanical means for holding said plates together.

* * * * *